United States Patent [19]

Niwa et al.

[11] Patent Number: 4,872,383

[45] Date of Patent: Oct. 10, 1989

[54] APPARATUS FOR CUTTING TUBULAR KNITTED FABRIC

[75] Inventors: Katuhiro Niwa; Nobuyasu Abe; Katuji Kajikiyo; Tsutomu Suzuoki; Katumi Tabuti; Yoshifumi Arii, all of Kyoto, Japan

[73] Assignee: Gunze Limited, Kyoto, Japan

[21] Appl. No.: 293,526

[22] Filed: Jan. 5, 1989

[30] Foreign Application Priority Data

Feb. 1, 1988 [JP] Japan ..... 63-22229

[51] Int. Cl.[4] ..... B26D 7/14

[52] U.S. Cl. ..... 83/175; 83/276; 83/437; 83/456; 83/564; 26/84

[58] Field of Search ..... 83/18, 54, 175, 276, 83/437, 563, 564, 566, 599, 597, 456; 26/83, 84

[56] References Cited

U.S. PATENT DOCUMENTS

| | | | |
|---|---|---|---|
| 3,076,249 | 2/1963 | Beard | 26/83 |
| 3,381,397 | 5/1968 | Cohn et al. | 83/18 X |
| 4,140,037 | 2/1979 | Gerber | 83/56 |
| 4,155,543 | 5/1979 | Costigan | 270/30 |
| 4,813,318 | 3/1989 | Suzuki | 83/566 X |

FOREIGN PATENT DOCUMENTS 61-52268 11/1986 Japan .

*Primary Examiner*—Donald R. Schran
*Assistant Examiner*—Eugenia A. Jones
*Attorney, Agent, or Firm*—Sixbey, Friedman, Leedom & Ferguson

[57] ABSTRACT

An apparatus comprising a movable frame reciprocatingly movable longitudinally of a tubular knitted fabric, a fixed press bed member spaced apart from the frame in the direction of transport of the fabric, at least one pair of upper and lower fabric feed rollers mounted on the frame and stoppably drivable in the transport direction, a tenter core member reciprocatingly movable with the frame for tentering the fabric as fitted therearound and having one end held by the feed rollers and the other end extending toward the press bed member, and a holding member for releasably pressing the fabric as tentered by the core member against the press bed member. The holding member is provided on the fabric facing side thereof with the cutter blade of a press cutter and elastic pieces. The cutter blade cuts the fabric as held to the press bed member by the elastic pieces after the tenter core member is retracted with the feed rollers driven in the transport direction to prevent the fabric from being stretched by the retraction.

3 Claims, 6 Drawing Sheets

APPARATUS FOR CUTTING TUBULAR KNITTED FABRIC

FIELD OF THE INVENTION AND RELATED ART STATEMENT

The present invention relates to an apparatus for cutting a tubular knitted fabric.

In producing underwear from an elongated tubular knitted fabric, it is desired to transport the fabric forward by a specified length at a time and cut the fabric by a sequential automatic operation. However, the knitted fabric, which is flexible and highly stretchable, is difficult to transport while tentering the fabric and permitting the fabric to retain its shape.

Moreover, the front and rear sides of the tubular fabric are in contact with each other, so that even if the fabric is transported by rollers, one side is likely to be displaced from the other side.

With reference to FIGS. 16 and 17, the width 314 of a tubular knitted fabric 214 is therefore likely to vary as indicated at 214A due to stretching. If the fabric 214 is cut as stretched as at 143A, the cut pieces of fabric 414 naturally have a variation indicated at 414A. When the cut pieces are sewed together, the product obtained involves a dimensional variation and will not have the desired quality. When not in conformity with the dimensional standard, there arises a need to sew the pieces again.

As disclosed in Examined Japanese Patent Publication No. SHO 61-52268, the present applicant has already proposed an apparatus wherein a fabric guide core member as inserted in a tubular knitted fabric is held between fabric feed rollers and reciprocatingly movable longitudinally of the fabric.

However, the proposed apparatus includes a pattern frame separate from the fabric guide core member, and is therefore complex in construction and likely to produce irregularities in the cut pieces when the fabric is cut after transport.

Further when the guide core member is retracted, the contact between the core member and the fabric is liable to stretch the fabric to create irregularities in the cut pieces.

OBJECTS AND SUMMARY OF THE INVENTION

The present invention has been accomplished to overcome the foregoing problems heretofore encountered.

A first object of the present invention is to provide an apparatus for cutting a highly stretchable flexible tubular knitted fabric wherein the fabric is held as tentered by a tenter core member inserted therein, and the core member is thereafter retracted from a cutting position so as to subsequently cut the fabric as specified without irregularities in the dimensions of tentered fabric despite the retraction.

A second object of the invention is make the tenter core member retractable from the cutting position while preventing the fabric from being stretched by the retraction so that the fabric can be cut as specified.

A third object of the invention is to enlarge the fabric when to be fitted around the tenter core member so as to render the core member insertable into the fabric with ease accurately and to cut the fabric as tentered with diminished dimensional variations.

To fulfill the first object, the present invention provides an apparatus for cutting a tubular knitted fabric wherein the fabric is transported longitudinally thereof and then cut to the shape of a product by a press cutter, the apparatus being characterized in that the apparatus comprises a movable frame reciprocatingly movable longitudinally of the tubular knitted fabric; a fixed press bed member spaced apart from the movable frame in the direction of transport of the fabric in series with the frame and provided for the press cutter; at least one pair of upper and lower fabric feed rollers mounted on the movable frame and stoppably drivable in the direction of transport of the fabric; a tenter core member reciprocatingly movable with the movable frame for tentering the fabric as fitted therearound, the tenter core member having at its one end a portion held by the feed rollers and the other end portion extending toward the press bed member; and a fabric holding member for releasably pressing the fabric as tentered by the tenter core member against the press bed member, the fabric holding member being provided on the fabric facing side thereof with a cutter blade for the press cutter and elastic pieces having a greater height than the cutter blade and elastically deformable for pressing the fabric against the press bed member before the cutter blade comes into contact with the fabric, the tenter core member being retractable with the fabric pressed against the press bed member by the elastic pieces, the cutter blade being movable in a cutting direction with the fabric pressed against the press bed member by the elastic pieces after the retraction of the tenter core member to cut the fabric by the cooperation of the cutter blade and the press bed member.

To fulfill the second object, the apparatus of the invention is further characterized in that the fabric feed rollers are driven in the fabric transport direction when the tenter core member is retracted with the fabric pressed against the press bed member by the elastic pieces to prevent the fabric from being stretched by the retraction of the tenter core member.

To fulfill the third object, the apparatus of the invention is further characterized in that the held portion of the tenter core member is provided with a plurality of driven rollers in an undulating arrangement longitudinally of the tubular knitted fabric for diametrically stretching the fabric fitted around the core member, and the driven rollers are rotatable by the fabric feed rollers.

BRIEF DESCRIPTION OF THE DRAWINGS

The drawings show a preferred embodiment of the invention.

FIG. 2 is a schematic side elevation showing the embodiment in its entirety;

FIG. 3 is a side elevation before cutting;

FIG. 4 is a side elevation after cutting;

DESCRIPTION OF THE PREFERRED EMBODIMENT

Figure 1:
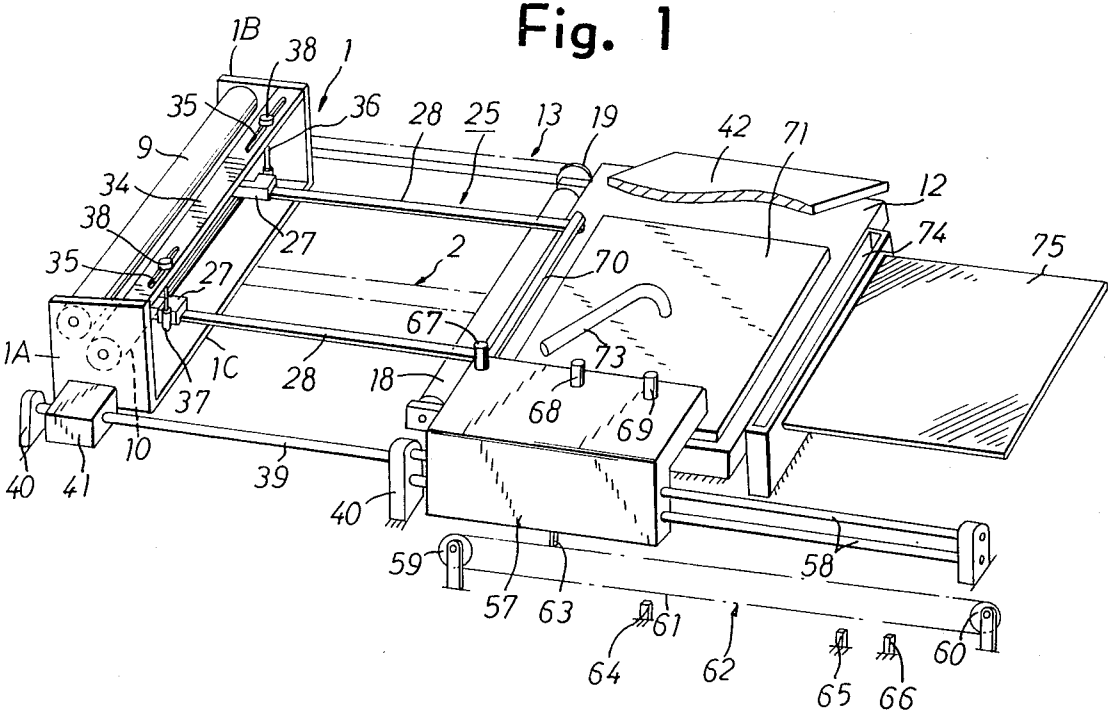
FIG. 1 is a perspective view schematically showing the embodiment in its entirety.
Figure 2:
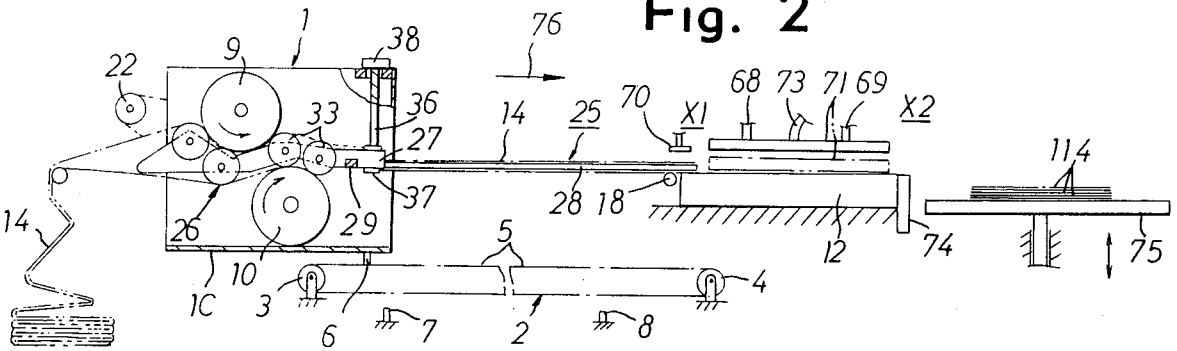
FIGS. 2 to 4 are side elevations showing the operation of the same step by step.

With reference to FIGS. 1 and 2, a movable frame 1 comprises a pair of side plates 1A and 1B, and a bottom plate 1C interconnecting the side plates and is in the form of a channel when it is seen from the front or rear.

Drive means 2 is disposed under the movable frame 1 for reciprocatingly moving the frame 1 longitudinally of a tubular knitted fabric 14. The drive means 2 comprises a pair of chain wheels 3, 4, an endless chain 5 reeved around the wheels, an unillustrated motor for reversibly driving one of the wheels, etc. A connector 6 on the bottom plate 1C of the movable frame 1 is attached to the chain 5.

When the frame 1 is reciprocatingly moved by the drive means 2 longitudinally of the tubular fabric 14, the retracted position and the advanced position of the frame 1 are detected respectively by sensors 7, 8, each comprising a reflective photoelectric tube, for stopping the frame 1 at these positions.

The movable frame 1 has a pair of upper and lower fabric feed rollers 9, 10 extending between and supported by the side plates 1A, 1B. The rollers are displaced from each other longitudinally of the apparatus.

A press bed member 12 is fixedly provided for a press cutter 11 to the front of the movable frame 1. Thus, the member 12 is spaced apart from the frame 1 in the direction of transport of the fabric in series with the frame.

Figures 5, 6, 7:
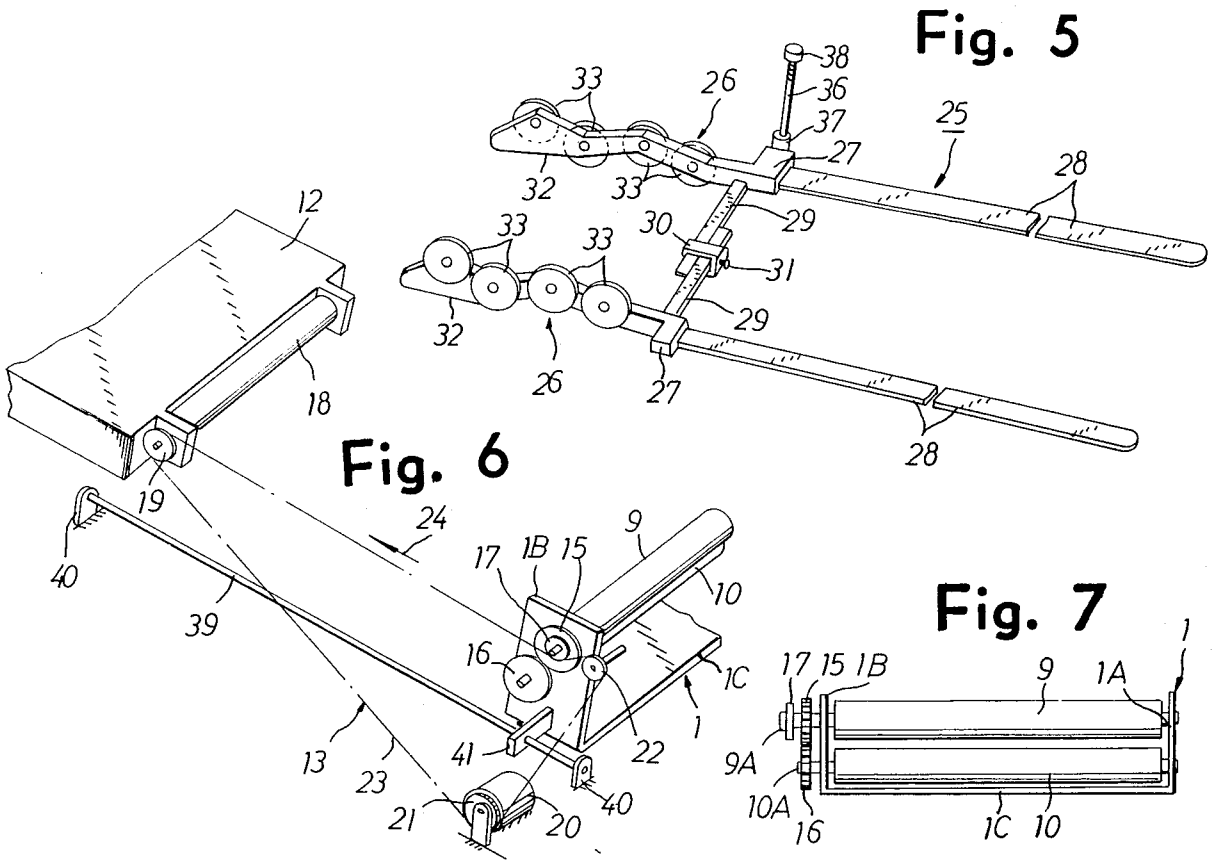
FIG. 5 is a perspective view of a tenter core member.
FIG. 6 is a perspective view showing a press bed member movable frame and drive means for the frame.
FIG. 7 is a rear view showing the movable frame and fabric feed rollers.

FIG. 6 shows in detail roller drive means 13 for rotating the feed rollers 9, 10 in the respective directions of arrows shown in FIG. 2 to transport the fabric 14 forward longitudinally thereof. With reference to FIG. 6, the roller drive means 13 comprises gears 15, 16 meshing with each other and fixed to roller shafts 9A, 10A, respectively, a sprocket wheel 17 having a one-way clutch and mounted on the roller shaft 9A, a driven sprocket wheel 19 fixed to one end of the shaft of a guide roller 18 rotatably supported by the rear portion of the press bed member 12, a motor 20 having a drive sprocket wheel 21, and an endless chain 23 in meshing engagement with the wheels 17, 19 and 21 and a guide sprocket wheel 22. The motor 20, when started, drives the chain 23 in circulation in the direction of arrow 24 in FIG. 6, whereby the rollers 9, 10 are driven in the respective directions of arrows shown in FIG. 2 through the engagment of the gears 15, 16, with the guide roller 18 also rotated in the fabric transport direction.

A tenter core member 25 has at its one end a portion 26 held between the feed rollers 9, 10. The other end of the core member 25 extends toward the press bed member 12 and rests on the guide roller 18.

With reference to FIG. 5, the tenter core member 25 comprises a pair of holders 27, and flat tenter plates 28 extending forward from the respective holders 27. Arms 29 extend inward toward each other from the respective holders 27, and are covered with a chuck holder 30 and fastened together with a bolt 31. When the bolt 31 is loosened, the distance between the tenter plates 28 is adjustable in accordance with the width of the fabric.

The rear portion of each holder 27 providing the held portion 26 is in the form of an undulating plate 32 carrying driven rollers 33 in an undulating arrangement longitudinally of the fabric. The tenter core member 25, as assembled in conformity with the contemplated amount of tentering, is inserted between the feed rollers 9, 10 rearward to engage the held portion 26 with the rollers 9, 10. Consequently, the member 25 is made reciprocatingly movable with the frame 1, and the driven rollers 33 are made rotatable by the rotation of the feed rollers 9, 10 while diameterically enlarging the fabric 14 as fitted around the member 25.

As seen in FIG. 1, the movable frame 1 has a top plate 34 formed with slits 35 extending lengthwise thereof and each having a bolt 36 extending therethrough. The bolt 36 carries at its lower end an idly rotatable roller 37 engageable with the outer side of the holder 27, whereby the position of the core member 25 can be determined transversely thereof. This position is adjustable within the range of the slits 35 by loosening nuts 38 screwed on the respective bolts 36.

With reference to FIGS. 1 and 6, the movable frame 1 is provided on each side thereof with a guide rod 39 supported by bearing brackets 40, and a slide block 41 projecting from the frame 1 and slidably mounted on the rod 39, whereby guide means is provided for guiding the movable frame 1 for straight reciprocating movement.

Disposed above the press bed member 12 is a fabric holding member 42 for releasably pressing the fabric 14 as tentered by the core member 25 against the member 12. The fabric holding member 42 is provided on the fabric facing side thereof with a cutter blade 43 for the press cutter 11 and elastic pieces 44 having a greater height than the cutter blade 43 and elastically deformable for pressing the fabric 14 against the press bed member 12 before the cutter blade comes into contact with the fabric 14.

Figure 10:
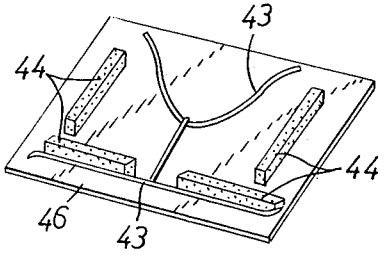
FIG. 10 is a fragmentary perspective view showing the cutter means.
Figure 9:
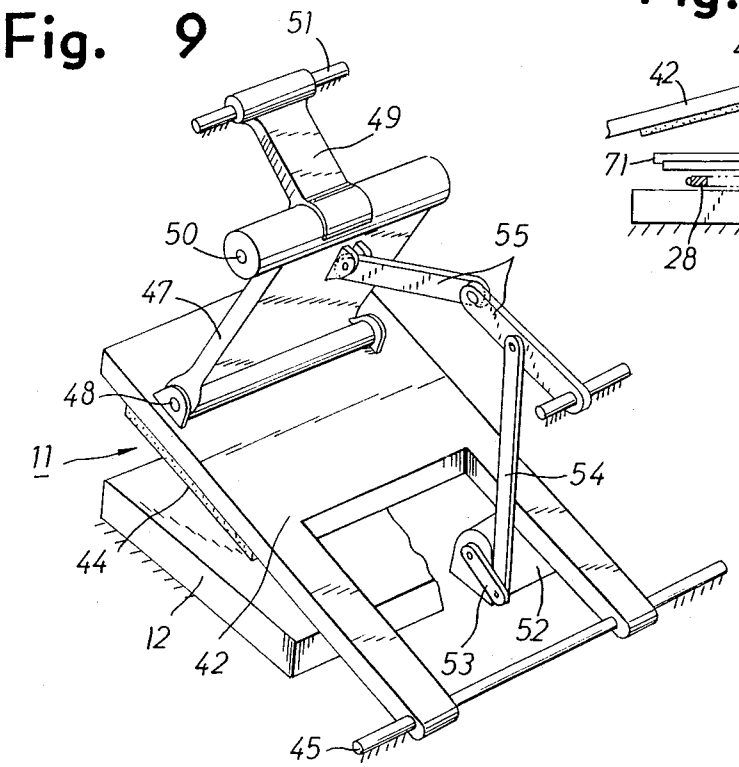
FIG. 9 is a perspective view of FIG. 9.

As seen in FIGS. 8 to 14, the fabric holding member 42 is pivotally movable to a position immediately above the press bed member 12 and away from the position by a link assembly. More specifically, the member 42 is upwardly or downwardly movably supported at its one end by a lateral pivot 45 and has a cutter mount plate 46 removably fixed by unillustrated bolts to its lower side, i.e., the fabric facing side. As shown in FIG. 10, the cutter blade 43 of short width is attached to the mount plate 46 so as to cut the fabric 14 to the configuration of the contemplated product. The elastic pieces 44, which are made of polyurethane foam or like highly flexible material, are attached to the plate 46 with an adhesive or the like.

A first link 47 pivoted by a pin 48 to the upper side of the holding member 42 is flexibly connected to a second link 49 by a pin 50. The second link 49 is supported by a pin 51.

Figure 13:
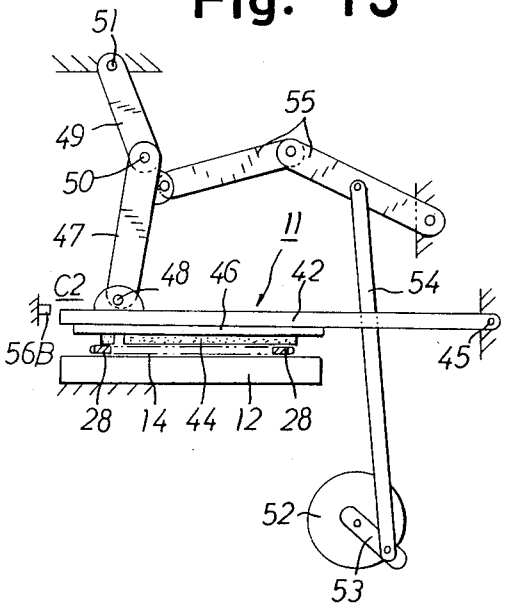
FIGS. 12 to 14 rear views showing the operation of the embodiment from fabric holding to cutting.
Figure 12:
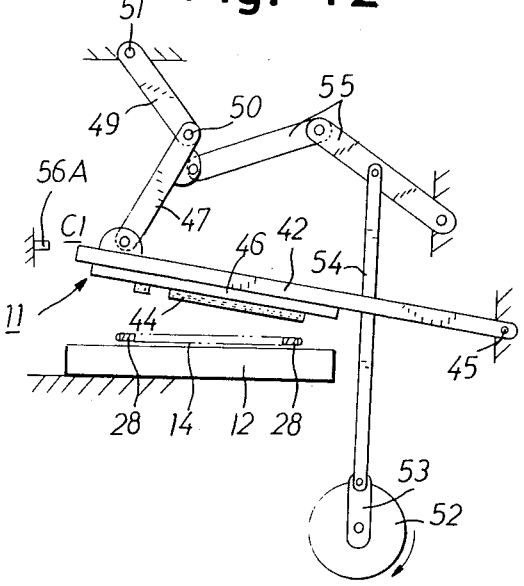
Figure 14:
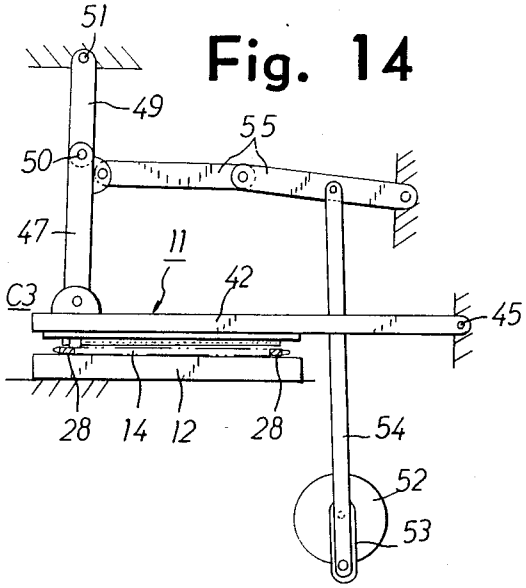
Figure 17:
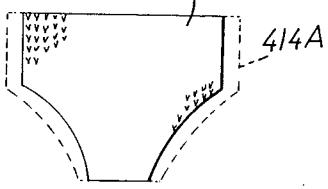
FIG. 17 is plan view showing the cut-off fabric.

A drive source 52, such as a brake motor having a reduction gear, has a crank arm 53, which is operatively connected to the first link 47 by a coupling link 54 and a flexible link 55. Thus, the holding member 42 is movable by the rotation of the crank arm 53 through the link assembly as seen in FIGS. 12 to 14, whereby the fabric 14 can be releasably pressed against the press bed member 12, and the fabric can be cut to the shape of product with the cutter blade 43.

The drive source 52 is controllable for energization and deenergization by sensors 56A, 56B, each comprising a proximity switch or the like, for detecting different positions of the holding member 42.

Figure 8:
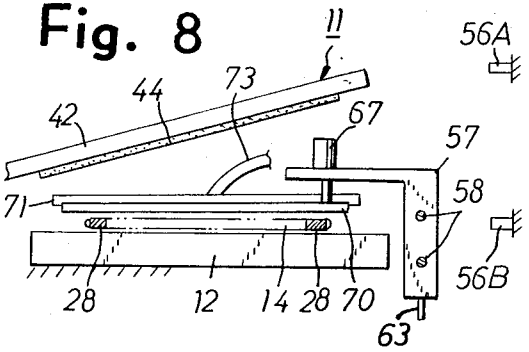
FIG. 8 is a rear view showing the press bed member, a fabric holding member and cutter means.

With reference to FIGS. 1 and 8, a slide block 57 is slidably provided on a pair of upper and lower guide rods 58 on one side of the holding member 42 opposite to the other side thereof where the link assembly is disposed. The slide block 57 is reciprocatingly movable longitudinally of the fabric by drive means 62 comprising a pair of sprocket wheels 59, 60 and an endless chain 61 reeved around the wheels. A connector 63 on the slide block 57 is attached to the chain 61. Sensors 64, 65, 66, each comprising a reflective photoelectric tube, are arranged for detecting different positions of the slide block 57 for stopping the block at these positions. A drive source, such as a suitable motor, is connected to one of the wheels 59, 60.

The slide block 57 has three air cylinders 67, 68, 69. Of these cylinders, the cylinder 67 moves a pressure plate 70 for releasably pressing the fabric against the press bed member 12 at the forward end of the tenter core member 25. The other cylinders 68, 69 raise or lower a suction member 71.

Figure 11:
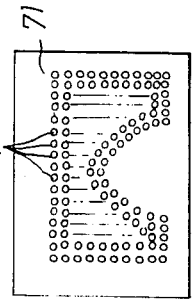
FIG. 11 is a bottom view showing cut fabric suction means.

The suction member 71 is in the form of a hollow box and is formed in the fabric facing side thereof with a multiplicity of vacuum perforations 72 as arranged in conformity with the shape of product as seen in FIG. 11. Cut-off fabric pieces 114 only are attracted to the suction member 71 by suction acting through a vacuum pipe 73.

Arranged in front of the press bed member 12 are a box 74 for collecting cut-off fragments 114A and a table 75 for placing the cut-off fabric thereon. The table 75 is vertically movable and is lowered every time the cut-off fabric 114 is placed thereon.

The operation of the present embodiment will be described next.

With reference to FIG. 2, an elongated tubular knitted fabric 14 is fitted around the tenter core member 25 at the held portion 26, and when the leading end of the fabric is passed through the space between the feed rollers 9, 10, the rollers 9, 10 are driven while pulling the fabric end forward with hand in the direction of arrow 76 in FIG. 2, whereby the fabric leading end is located at the position X1 of the forward end of the tenter core member 25.

When thus pulled out, the fabric 14 is enlarged by the held portion 26 and tentered to the specified size by the tenter plates 28 of the core member 25.

Next, with the feed rollers 9, 10 stopped, the pressure plate 70 and the suction member 71 waiting at the positions X1, X2 above the press bed member 12 are lowered by the operation of the cylinders 67, 68, 69, whereby the pressure plate 70 is pressed against the forward ends of the tenter plates 28, and the suction member 71 against the press bed member 12. The fabric end is pressed on by the pressure plate 70, and the suction 71 starts suction.

Figure 3:
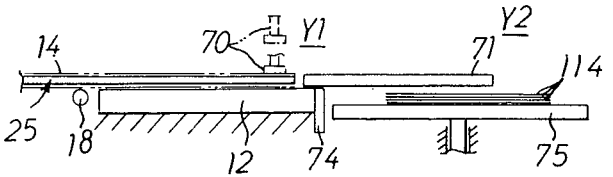

In this state, the movable frame 1 and the slide block 57 are advanced at the same speed by the drive means 2 and the drive means 62, respectively, advancing the pressure plate 70 to a position Y1 and the suction member 71 to a position Y2 as seen in FIG. 3, whereupon the plate and member are halted. Consequently, the leading end of the fabric 14 tentered as fitted over the tenter core member 25 is transported to the position Y1.

Thus, the movable frame 1 and the tenter core member 25 are advanced with the position thereof relative to each other remaining unchanged in the direction of transport of the fabric.

In the meantime, the roller drive means 13 shown in FIG. 6 is out of operation, rendering the sprocket wheel 17 free to rotate on the chain 23 and permitting the roller 9 to advance without acting to transport the fabric forward.

Figure 4:
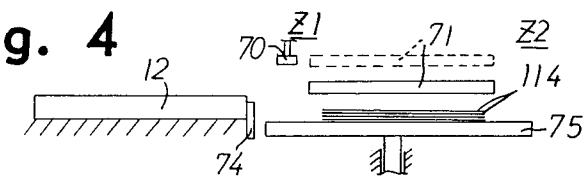

Subsequently, the pressure plate 70 only is raised to the broken-line position shown in FIG. 3 at the position Y1 by the operation of the air cylinder 67 to release the fabric leading end. The pressure plate 70 and the suction member 71 are advanced to positions Z1, Z2, respectively, as seen in FIG. 4, whereupon the plate and the member are stopped. At the same time, the suction member 71 in the stopped position is raised to the broken-line position in FIG. 4 while being brought out of the sucking operation.

On the other hand, the tubular fabric 14 transported onto the press bed member 12 is to be cut by the press cutter 11 in the following manner.

First, the rotation of the motor 52 starts lowering the fabric holding member 42 from the position C1 of FIG. 12 through the crank motion of the crank arm 53 by way of the links 47, 49, 55. Upon the sensor 56B detecting the holding member 42, this member stops at a position C1, where the member 42 is held for a required period of time through the action of an unillustrated timer, permitting the elastic pieces 44 only to press the fabric 14 against the press bed member 12.

Since the elastic pieces 44 have a greater height than the cutter blade 43, the fabric 14 covering the tenter plates 28 of the core member 25 is pressed as tentered against the press bed member 12 by the elastic pieces 44 before the cutter blade 43 comes into contact with the fabric.

With the fabric 14 thus pressed on, the tenter core member 25 is retracted along with the movable frame 1 to the position X1 shown in FIG. 2, rendering the cutter blade 43 ready to cut the fabric.

During the retraction of the frame 1 and the core member 25, the frictional contact of the core member 25 with the fabric 14 tends to stretch the fabric 14, but this tendency is compensated for in the following manner to prevent the fabric from stretching.

During the return of the frame 1 and the member 25 to the original position, the chain 23 is driven in the direction of arrow 24 shown in FIG. 6 to rotate the feed rollers 9, 10 and the guide roller 18 by virtue of the rotation of the sprocket wheel 17 and the meshing engagement between the gears 15, 16. The rollers 9, 10 and 18 are rotated at a peripheral speed equal to the speed of retraction of the movable frame 1, thereby transporting the tubular fabric 14 forward and preventing the fabric from stretching.

Subsequently, the holding member 42 waiting at the position C2 as seen in FIG. 13 is further lowered to a position C3 as seen in FIG. 14 by the operation of the motor 52, whereby the fabric 14 as pressed on by the elastic pieces 44 is cut as indicated at 43A in FIG. 15 by the cooperation of the cutter blade 43 and the press bed member 12.

The motor 52 further starts raising the holding member 42 lowered to the position C3 as stated above. When the member 42 is raised to the position C1 in FIG. 12, the sensor 56A detects this to stop the holding member 42 at this position.

On the other hand, the pressure plate 70 and the suction member 71 in the respective positions Z1, Z2 in FIG. 4 are retracted to the positions X1, X2 of FIG. 2, respectively, and lowered. The leading end of the fabric resulting from the cutting operation is pressed on by the pressure plate 70, and the cut fabric 114 only is drawn to the suction member 71. In this state, the pressure plate 70 and the suction member 71 are advanced to the positions Yl, Y2, respectively, as shown in FIG. 3.

Figure 15:
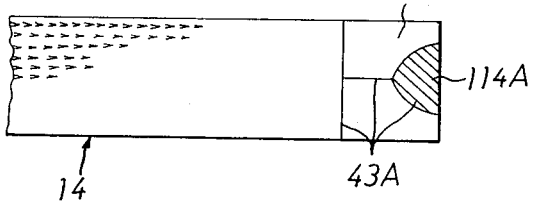
FIG. 15 is a plan view showing the shape to which a fabric is cut.
Figure 16:
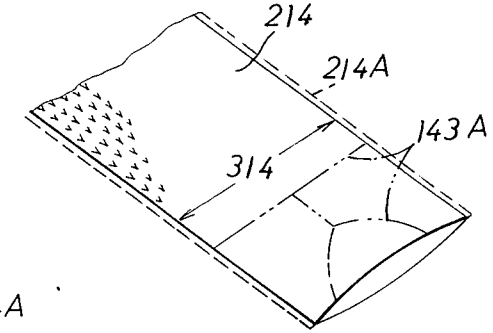
FIG. 16 is a perspective view showing a fabric when it is cut as tentered improperly.

During the advance of the suction member 71, the cut-off fragment 114A shown in FIG. 15 is forwarded by being pushed by the suction member 71 and collected in the box 74.

Upon the pressure plate 70 reaching the position Yl, the plate 70 is raised in this position to release the fabric leading end as seen in FIG. 2. The pressure plate 70 and the suction member 71 are advanced to the positions Z1, Z2 of FIG. 4, respectively, whereupon the suction member 71 is brought out of sucking operation, allowing the cut-off fabric 114 to fall onto the table 75. The same cutting operation as above is thereafter repeated.

What is claimed is:

1. An apparatus for cutting a tubular knitted fabric wherein the fabric is transported longitudinally thereof and then cut to the shape of a product by a press cutter, the apparatus being characterized in that the apparatus comprises:

a movable frame reciprocatingly movable longitudinally of the tubular knitted fabric, a fixed press bed member spaced apart from the movable frame in the direction of transport of the fabric in series with the frame and provided for the press cutter, at least one pair of upper and lower fabric feed rollers mounted on the movable frame and stoppably drivable in the direction of transport of the fabric, a tenter core member reciprocatingly movable with the movable frame for tentering the fabric as fitted therearound, the tenter core member having at its one end a portion held by the feed rollers and the other end extending toward the press bed member, and a fabric holding member for releasably pressing the fabric as tentered by the tenter core member against the press bed member, the fabric holding member being provided on the fabric facing side thereof with a cutter blade for the press cutter and elastic pieces having a greater height than the cutter blade and elastically deformable for pressing the fabric against the press bed member before the cutter blade comes into contact with the fabric, the tenter core member being retractable with the fabric pressed against the press bed member by the elastic pieces, the cutter blade being movable in a cutting direction with the fabric pressed against the press bed member by the elastic pieces after the retraction of the tenter core member to cut the fabric by the cooperation of the cutter blade and the press bed member.

2. An apparatus as defined in claim 1 wherein the fabric feed rollers are driven in the fabric transport direction when the tenter core member is retracted with the fabric pressed against the press bed member by the elastic pieces to prevent the fabric from being stretched by the retraction of the tenter core member.

3. An apparatus as defined in claim 1 wherein the held portion of the tenter core member is provided with a plurality of driven rollers in an undulating arrangement longitudinally of the tubular knitted fabric for diametrically stretching the fabric fitted around the core member, and the driven rollers are rotatable by the fabric feed rollers.

* * * * *